United States Patent [19]

Junkers

[11] 4,446,762

[45] May 8, 1984

[54] UNIVERSALLY USABLE HYDRAULIC WRENCH FOR SIMULTANEOUSLY TIGHTENING OR LOOSENING TWO THREADED CONNECTORS OR FOR TIGHTENING OR LOOSENING A SINGLE THREADED CONNECTOR WITH A GREATER FORCE

[76] Inventor: John K. Junkers, 7 Arrowhead La., Saddle River, N.J. 07458

[21] Appl. No.: 521,161

[22] Filed: Aug. 5, 1983

Related U.S. Application Data

[63] Continuation-in-part of Ser. No. 315,998, Oct. 28, 1981, Pat. No. 4,406,185, which is a continuation-in-part of Ser. No. 265,234, May 19, 1981, Pat. No. 4,387,611.

[51] Int. Cl.[3] ..... B25B 13/00

[52] U.S. Cl. ..... 81/57.39; 81/57.36

[58] Field of Search ..... 81/57.39, 57.36

[56] References Cited

U.S. PATENT DOCUMENTS

| | | | |
|---|---|---|---|
| 3,138,397 | 6/1964 | Griffiths | 81/57.36 |
| 3,287,999 | 11/1966 | Kreckel et al. | 81/57.36 |
| 4,387,611 | 6/1983 | Junkers | 81/57.39 |
| 4,406,185 | 9/1983 | Junkers | 81/57.39 |

*Primary Examiner*—James L. Jones, Jr.
*Attorney, Agent, or Firm*—Michael J. Striker

[57] ABSTRACT

A hydraulically operated wrench which can be used either for simultaneously tightening or loosening two threaded connectors or to apply the full force of the wrench to tighten or loosen only a single threaded connector. The wrench includes a cylinder and a piston reciprocating therein, side plates connected to the cylinder, a drive lever mounted intermediate its ends on the side plates for pivoting about a first pivot axis and operatively connected at one end to the piston while being provided at the other end with a polygonal opening for engaging a polygonal member of a first threaded connector to be turned. A drive link provided at one end with a polygonal opening for drivingly engaging a polygonal member of a second threaded connector to be turned and an anchoring link provided at one end with an opening for turnably surrounding the polygonal member of the second threaded connector may be selectively attached at the other end to the side plates for pivoting about a second pivot axis spaced from and parallel to the first pivot axis. The wrench includes also an arrangement for exactly changing the distance between the first and the second pivot axes.

9 Claims, 3 Drawing Figures

UNIVERSALLY USABLE HYDRAULIC WRENCH FOR SIMULTANEOUSLY TIGHTENING OR LOOSENING TWO THREADED CONNECTORS OR FOR TIGHTENING OR LOOSENING A SINGLE THREADED CONNECTOR WITH A GREATER FORCE

CROSS-REFERENCES TO RELATED APPLICATIONS

The present application is a continuation-in-part of the copending application Ser. No. 315,998 filed Oct. 28, 1981, now U.S. Pat. No. 4,406,185, which in turn is a continuation-in-part of the application Ser. No. 265,234 filed May 19, 1981, now U.S. Pat. No. 4,387,611.

BACKGROUND OF THE INVENTION

There are many applications in which a plurality of threaded connectors, usually arranged spaced from each other along a circle, have to be tightened or loosened. Until now such threaded connectors have been individually tightened, which of course is quite a time-consuming task. Hydraulic wrenches are rather heavy and may weigh up to 200 pounds, and such heavy wrenches have to be lifted and lowered by a crane to apply such wrenches to successive threaded connectors to be tightened or loosened. The set-up time for moving the wrench from one to the next threaded connector may therefore be from 5 minutes up to half an hour. While for some special applications apparatus have already been provided by means of which several bolts or threaded connectors could be tightened or loosened simultaneously, such known apparatus is extremely complicated, heavy and expensive, so that the handling thereof is likewise difficult.

In many applications, the available overhead space for applying a hydraulic wrench is so small that hydraulic wrenches of known constructions could not be used, and in such cases box wrenches have been used to which hammer blows have been applied to tighten or loosen a threaded connector. Of course in such cases a proper tightening of the threaded connector with a predetermined force could never be obtained.

Especially in loosening a threaded connector, which may be partly corroded, a greater force may be required than for originally tightening the same to a predetermined degree. In such case, a hydraulic wrench with a power for originally tightening the threaded connectors to the desired degree may be insufficient for loosening the same again.

SUMMARY OF THE INVENTION

It is one object of the present invention to provide a hydraulically operated wrench in which two threaded connectors may be simultaneously tightened or loosened, to thereby reduce the time for tightening or loosening a great number of threaded connectors.

It is an additional object of the present invention to provide a hydraulic wrench for simultaneously tightening or loosening two threaded connectors regardless of the spacing of the two threaded connectors from each other.

It is a further object of the present invention to provide a hydraulic wrench for simultaneously tightening or loosening two threaded connectors in which the overhead space for applying the wrench is extremely limited.

It is also an object of the present invention to provide a hydraulic wrench for simultaneously tightening or loosening two threaded connectors which can be quickly adapted for tightening and especially for loosening only a single threaded connector in which the full force of the hydraulic wrench is applied only to the single threaded connector.

With these and other objects in view which will become apparent as the description proceeds, the hydraulic wrench of the present invention may comprise fluid-operated cylinder-and-piston means including a cylinder having an axis, a piston reciprocatable along said axis in the cylinder between an active stroke and a return stroke, connecting means connected to the cylinder, elongated drive lever means provided in the region of one end with means for drivingly engaging a polygonal member of a first threaded connector to be turned during the active stroke of the piston, first mounting means for mounting said drive lever means intermediate its ends on the connecting means for tilting movement about a first pivot axis with the other end of the drive lever means operatively connected to the piston, elongated drive link means provided in the region of one end for drivingly engaging a second threaded connector to be turned during the active stroke of said piston, elongated anchoring link means provided in the region of one end for engaging a second threaded connector adjacent the first threaded connector, and second mounting means for releasably mounting the other end of either the drive link means or the anchoring link means on the connecting means for tilting movement about a second pivot axis parallel to and transversely spaced from the first pivot axis, whereby when the drive link means is connected to the connecting means two threaded connectors may be turned simultaneously during the active stroke of the piston, while when said anchoring link means is connected to the connecting means the full force of the cylinder-and-piston means may be used to drive only the first threaded connector while the anchoring link means transmits the reaction force occurring during such turning to the second threaded connector.

The hydraulic wrench of the present invention includes further means on the connecting means and cooperating with the second mounting means for changing the distance between the first and the second pivot axes.

This distance changing means is constructed so as to maintain the distance between the first and second pivot axes substantially equal to the center distance between the first and the second threaded connector when either the drive link means or the anchoring link means is attached to the connecting means, or when the anchoring link means is attached to the connecting means to maintain the distance between the first and the second pivot axes smaller than the center distance between the first and the second threaded connector, so as to increase the force with which the first threaded connector is turned.

The aforementioned connecting means preferably comprise elongated side plate means attached to the cylinder of the cylinder-and-piston means.

The distance changing means may be of various constructions, as for instance disclosed in the applications referred to above in the "Cross-References to Related Applications", preferably the distance changing means comprises, as hereinafter disclosed more specifically, a pair of arm means and means for fastening one of the arm means at any selected angular position to the connecting means and to fasten the other arm means at one end at any selected angular position to the one arm means, the second mounting means being arranged on the other end of the other arm means.

The elongated anchoring link means may comprise elongated plate means connected at one end to the distance changing means for tilting movement about the second pivot axis and means in the region of the other end thereof for at least partly surrounding the second threaded connector while permitting said plate means to freely tilt relative thereto.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

DESCRIPTION OF THE PREFERRED EMBODIMENT

Figure 1:
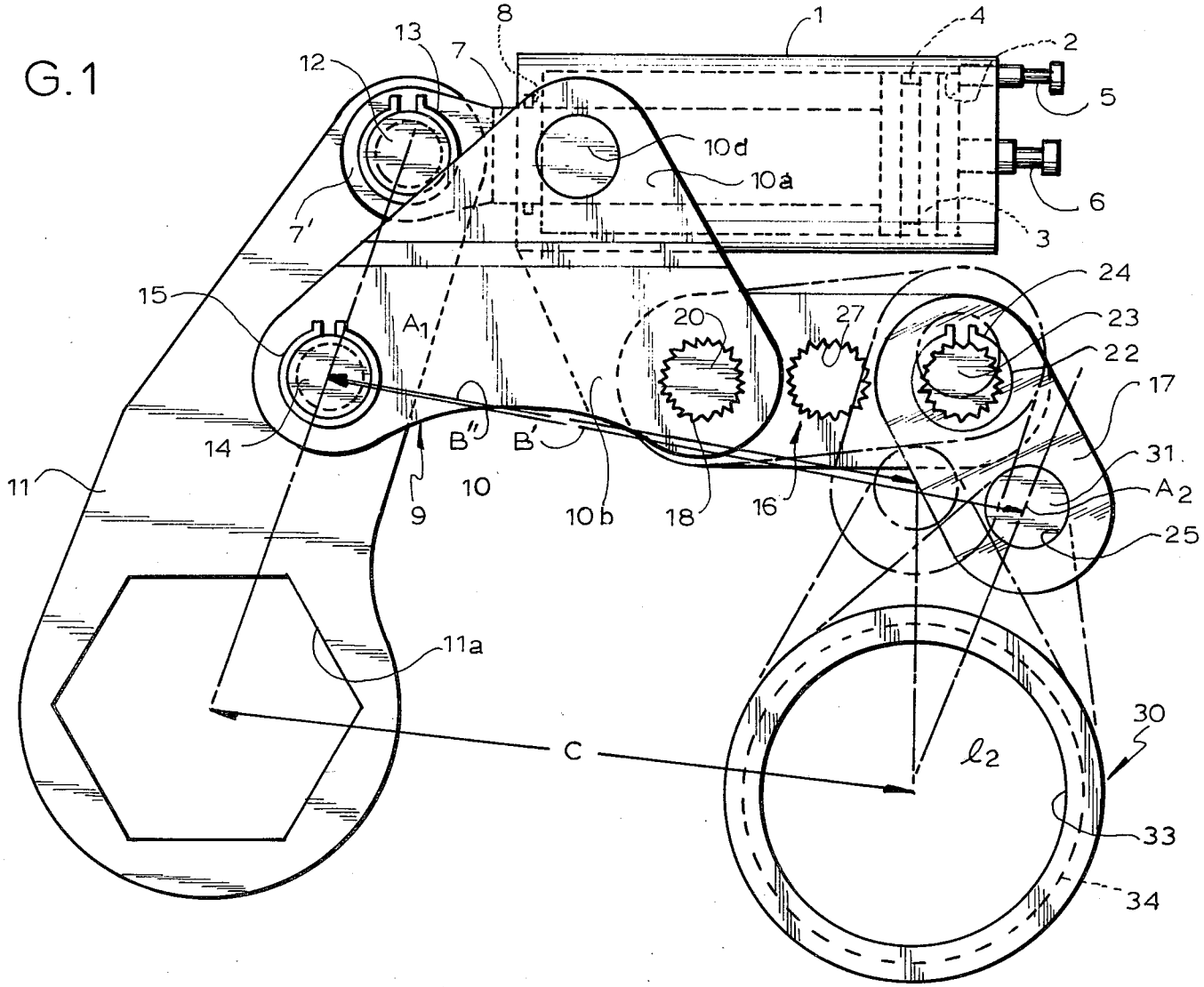
FIG. 1 is a side view of a preferred embodiment of the present invention showing a preferred distance changing means.
Figure 2:
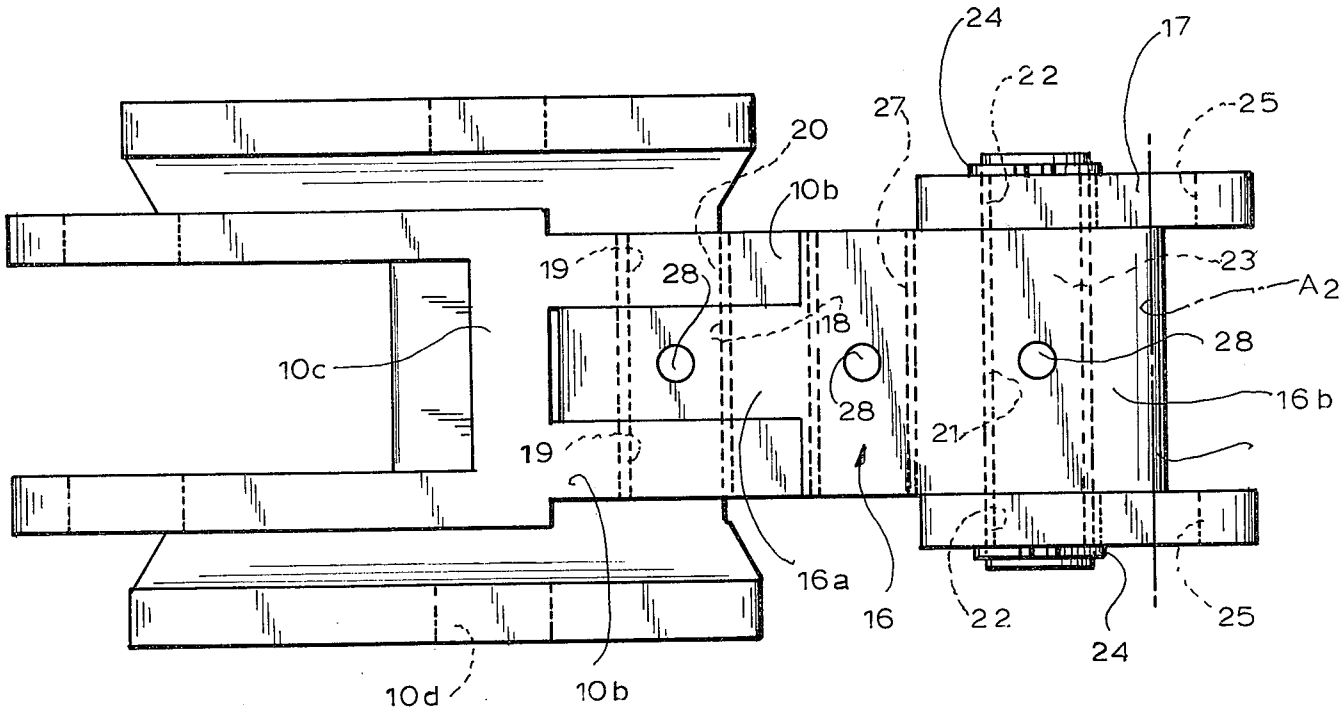
FIG. 2 is a partial top view of this embodiment with the cylinder-and-piston means, the drive lever means and the link means removed.

Referring now to the drawing, and more specifically to FIGS. 1 and 2 of the same, it will be seen that the hydraulic wrench according to the present invention comprises a unit including a fluid-operated cylinder-and-piston means, that is a cylinder 1 provided with a cylinder bore 2 and in which a piston 3 having an annular seal 4 is reciprocatable between an active stroke, towards the left as viewed in FIG. 1, and a return stroke. Nipples 5 and 6 are threadedly connected in corresponding bores in the right-hand end wall of the cylinder 1 and communicate through appropriate passages with opposite ends of the cylinder 2 for feeding, respectively discharging, pressure fluid in a known manner from a source, not illustrated in the drawing, into and from the cylinder to thereby reciprocate the piston between the active and the return stroke. A piston rod 7 is connected at one end in any suitable manner to the piston 3, concentric therewith, to project with its left end, as viewed in FIG. 1, sealed by a sealing ring 8 through an opening in the left end wall of the cylinder 1 beyond the latter. The unit further comprises connecting means 9 including a pair of transversely spaced, substantially parallel side plates 10 of substantially triangular configuration, as best shown in FIG. 1, and each has an upper wider portion 10*a* and a lower narrower portion 10*b* integrally connected to each other at 10*c*, as best shown in FIG. 2. The two side plates 10 are respectively preferably pivotally connected in the region of the upper ends thereof by connecting pins 10*d* screwed into blind bores in the region of the front or left end of the cylinder 1.

The hydraulic wrench includes further elongated drive lever means 11 which may comprise, as shown in FIG. 1, a single plate-shaped lever provided in the region of its lower end with a polygonal, for instance hexagonal, opening 11*a* drivingly engaging the polygonal member of a first threaded connector to be turned during the active stroke of the piston 3 in the cylinder bore 2. The upper end of the elongated drive lever means 11 is preferably releasably and pivotally connected by a pin 12 to the front end 7′ of the piston rod projecting beyond the cylinder 1. This front end 7′ of the piston rod is preferably fork-shaped, so that the upper end of the elongated drive lever means 11 may be located between the two prongs of the fork-shaped front end 7′ of the piston rod. The pin 12 extends through aligned bores provided in the fork-shaped front end 7′ of the piston rod and in the upper end of the elongated drive lever means 11 and is releasably held therein by snap rings 13 provided in appropriate grooves of the pin 12 at opposite sides of the prongs of the fork-shaped end 7′ of the piston rod. First mounting means are provided for preferably releasably mounting the drive lever means 11 intermediate its ends on the connecting means 9 for tilting movement about a first pivot axis $A_1$ at the region of the left end, as viewed in FIG. 1, of the triangular-shaped side plates 10. This first mounting means includes a pin 14 extending through aligned bores in the side plates 10 and the drive lever means 11 and again snap rings 15 in appropriate grooves at end portions of the pin 14 projecting beyond the side plates 10 are provided for releasably holding the pin 14 in the aforementioned aligned bores.

The drive lever means 11 are preferably, as mentioned before, releasably attached by the pins 12 and 14 to the front end of the piston rod, or the side plate, so that the drive lever means 11 may be exchanged for a drive lever means of different construction, for instance with an opening 11*a* of different size or configuration.

The wrench includes further first arm means 16 connected in the region of one end to the right end portion, as viewed in FIG. 1, of the lower portions 10*b* of the side plates 10 and second arm means 17 connected at one end in a manner to be described to the other end of the first arm means 16. The first arm means 16 comprises a smaller central portion 16*a* extending between the lower portions 10*b* of the side plates 10 and a wider portion 16*b* projecting beyond the portion 16*a* symmetrically arranged with respect thereto. The second arm means 17 comprises a pair of arms arranged on opposite sides of the larger portion 16*b* of the first arm means 16 and projecting beyond the right end, as viewed in FIG. 1, of the latter. The first arm means 16 are connected to the connecting means 9 for changing the angular position of the first arm means with respect to the connecting means 9. For this purpose a spline connection is provided between these two members comprising a splined bore 18 in the central portion 16*a* of the first arm means 16 and a pair of splined bores 19, aligned with the bore 18, in the region of the right end portion, as viewed in FIGS. 1 and 2, of the lower side plate portions 10*b*, as well as a splined pin 20 extending through the aligned bores 18 and 19. It will be understood that, by this spline connection, the angular position of the first arm means 16 may be changed with respect to the connecting means 9. The two arms 17 of the second arm means are likewise connected by a spline connection to the wider portion 16*b* of the first arm means 16. This latter spline connection likewise comprises at least one splined bore 21 extending parallel to the bore 18 through the wider portion 16*b* of the first arm means and a pair of splined bores 22 aligned with the bore 21 respectively extending through the left end portions, as viewed in FIGS. 1 and 2, of the arms 17 of the second arm means, as well as a splined pin 23 extending through the aligned bores 21 and 22. Snap rings 24 are provided in appropriate grooves formed at the outer ends of the pin 23 to assure that these arms may not slip off the ends of the pins 23. It will be understood that the spline connection between the first and second arm means permits to change the angular position between the two arm means. The two arms 17 of the second arm means are further formed transversely spaced from the bores 22 with circular bores 25 aligned along a common axis 26 forming a second pivot axis $A_2$ parallel not only to the axis of the bores 21 and 22 but also parallel to the first pivot axis $A_1$. The first arm means 16 may also be provided in the wider portion 16*b* with a second splined bore 27 between the bores 18 and 21, so that the splined pin 23 connecting the arms 17 of the second arm means may either extend through the bore 21 or to the other splined bore 27. Preferably threaded bores 28 respectively normal to the bores 18, 21 and 27 for set screws, are respectively provided to hold the splined pins 20 and 23 in proper position in the respective bores 18, 21 or 27.

Figure 3:
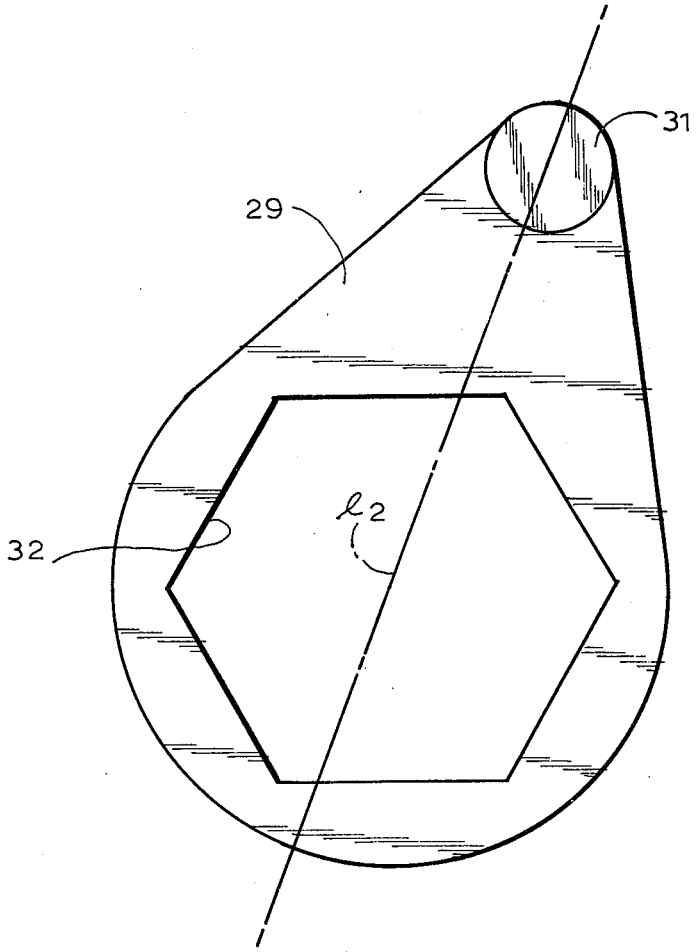
FIG. 3 is a side view of the drive link means which may be attached to the distance changing means instead of the anchoring link means shown in FIG. 1.

To make the wrench universally usable, it is further supplied with elongated drive link means 29 as shown in FIG. 3, as well as with elongated anchoring link means 30 as shown in the assembly of FIG. 1. Either of these link means may be mounted in the bores 25 of the second arm means 17 for pivotal movement about the axis 26 of these bores, also called the second pivot axis $A_2$. Each of these link means is plate-shaped and may be mounted in the bores 25 by means of trunnions 31 projecting from the upper end of each of the link means to opposite sides of the latter. The transverse spacing of the second arms 17 from each other is considerably greater than the width of each plate-shaped link means, and appropriate spacer rings are provided on the trunnion 31 to keep the respective link means centrally between the arms 17 of the second arm means.

The drive link means 29 is used if two adjacent polygonal members of threaded connectors have to be turned simultaneously, and for this purpose the drive link means 29 is provided in the lower portion thereof with a polygonal, for instance hexagonal opening 32 for engaging a polygonal member, for instance a hexagonal nut of a second threaded connector while a corresponding nut of a first threaded connector is engaged in the opening 11*a* of the drive lever means 11, so that both nuts may be turned simultaneously as will be explained later on.

If only a single polygonal member of the threaded connector has to be turned with the wrench according to the present invention, then the drive link means 29 shown in FIG. 3 is replaced by the anchoring link means 30 as shown in the assembly of FIG. 1. This anchoring link means 30 is not provided with a hexagonal opening 32 as shown for the drive link means 29 in FIG. 3, but with a circular opening 33 adapted to surround the polygonal member of a second threaded connector adjacent the polygonal member of a first threaded connector engaged in the opening 12 of the drive lever means 11. The opening 33 may be provided in a sleeve-type bearing set into the lower part of the anchoring link means 30, or a needle bearing 34 may be provided as schematically indicated in FIG. 1, to reduce the friction further.

The above described hydraulic wrench operates as follows:

Assuming the hydraulic wrench of the present invention is used for turning two polygonal members of two adjacent threaded connectors simultaneously, to either tighten or loosen the same, the anchoring link means 30 shown in FIG. 1 is replaced by the driving link means 29 shown in FIG. 3, and a polygonal member of a first threaded connector to be turned is engaged in the opening 11*a* of the drive lever means 11, and a polygonal member of a second threaded connector is engaged in the opening 32 of the drive link means 29. During the active stroke of the piston 3 in the cylinder 1 towards the left, as viewed in FIG. 1, the drive plate means 11 will be tilted about the axis of the first polygonal member engaged in the opening 11*a* thereof in counterclockwise direction, which in turn will shift the cylinder 1 and the connecting means 9 in the direction of the active stroke due to the connection of the connecting means 9 to the drive lever means 11 by the pivot pin 14. This in turn will also shift the first arm means 16 and the second arm means 17 in the same direction, to thereby tilt the drive link means 29 likewise in counterclockwise direction, so that both threaded connectors will be simultaneously turned. In order to assure that both threaded connectors will be turned with the same force, it is thereby important that the line $l_1$ passing through the center of the polygonal opening 11*a* and the center of the pivot pin 14 is parallel to the line $l_2$ passing through the center of the polygonal opening 32 and the center of the trunnions 31, in which case the distance C between the centers of the two polygonal openings 11*a* and 32 is equal to the distance B', that is the distance between the first pivot axis $A_1$ and the second pivot axis $A_2$. This can be accomplished in a very exact manner by adjusting the angular position of the first arm means 16 with regard to the connecting means 9 and the angular position of the second arm means 17 with respect to the first arm means.

If the polygonal members engaged in the openings 11*a* and 32 should not be sufficiently tightened during the single stroke of the piston, the drive plate means 11 and the drive link means 29 have to be disengaged from the respective polygonal members and be reset to the position shown in FIG. 1 and subsequently be reengaged with the two polygonal members to be further turned during the next active stroke of the piston 3. Preferably, the reciprocation of the piston 3 in the cylinder bore 2 is to be stopped, in a manner known in the art, during the resetting.

If the hydraulic wrench according to the present invention is to be used to turn only a single polygonal member with a greater force, then the drive link means 29 is replaced by the anchoring link means 30, as shown in FIG. 1, and a polygonal member to be turned is engaged in the polygonal opening 11*a* of the drive lever means 11, while the circular opening 33 of the anchoring link means 30 surrounds a second polygonal member adjacent to the first polygonal member to be turned and takes up the reaction force occurring during such turning of the first polygonal member. If in this case the angular position of the first arm means 16 and the second arm means 17 with respect to each other and with respect to the connecting means 9 is again adjusted in such a manner that the distance C is equal to the distance B', the drive lever means 11 will be turned during the active stroke of the piston, and the polygonal member engaged in the opening 12 of the drive lever means will be tightened or loosened with the full force of the cylinder-and-piston means.

Especially during loosening of a threaded connector it sometimes happens that the latter is partly corroded, and the full force of the cylinder-and-piston means would not be sufficient to turn the same; then this force may be increased by making the distance B" smaller than the distance C by properly adjusting the angular position of the first arm means 16 and the second arm means 17 with respect to each other and with respect to the connecting means 9, as shown in dotted lines in FIG. 1, in which case the two arm means together with the connecting means 9 and the anchoring link means 30 will act like a toggle lever, thereby increasing the force with which the drive lever means 11 is turned.

The first arm means 16 and the second arm means 17 together with the spline connections of the two arm means with each other and that of the first arm means with the connecting means 9 therefore form distance changing means for changing the distance between the first and the second pivot axes. On the other hand, the pivot pin 14 constitutes a first mounting means for preferably releasably mounting the drive lever means 11 intermediate its ends on the connecting means, whereas the trunnions 31 form second mounting means for releasably mounting either of the link means for tilting movement about a second pivot axis parallel to and transversely spaced from the first pivot axis.

The illustrated preferred embodiment, in which the drive lever means 11 as well as the drive link means 29 and the anchoring link means 30 are respectively constituted by a single plate-shaped member, is used in applications in which the overhead space for applying the wrench is extremely small. As mentioned before, the transverse distance between the two arms of the second arm means 17, as well as the transverse distance of the lower portions of the side plates 10 at the front end of which the drive lever means 11 are pivotally mounted, is considerably greater than the width of the drive lever means 11, respectively the width of the plate-shaped drive link means 29 or anchoring link means 30, so that the specific distance changing means constituted by the first and second arm means 16, 17 may also be used in connection with other drive lever means and link means, as for instance ratchet drive lever means and ratchet-type link means as disclosed in FIG. 1 of the copending application Ser. No. 315,998. If in this case a mechanism is provided to disengage the pawls from the ratchet gear of the link means as shown and described in connection with FIG. 1 of the aforementioned application, it would not be necessary, in the case that only a single connector has to be turned, to replace the drive link means with anchoring link means as described above in connection with the preferred embodiment illustrated in the present application; instead, the link means shown in FIG. 1 of the mentioned copending application could be used as driving link means when the pawls thereof are engaged with the teeth of the ratchet gear, or as an anchoring link means when the pawls are disengaged.

It will be understood that each of the elements described above, or two or more together, may also find a useful application in other types of hydraulic wrenches for simultaneously tightening or loosening two threaded connectors or for tightening and loosening a single threaded connector with a greater force, differing from the types described above.

While the invention has been illustrated and described as embodied in a hydraulic wrench for simultaneously tightening or loosening two threaded connectors or a single threaded connector with a greater force, which is especially usable for applying the wrench in situations where the overhead space available for applying the wrench is extremely limited, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic wrench comprising fluid-operated cylinder and piston means including a cylinder having an axis, a piston reciprocatable along said axis in said cylinder between an active stroke and a return stroke; connecting means connected to and projecting from one side of said cylinder; elongated drive lever means provided in the region of one end thereof with means for drivingly engaging a polygonal member of a first threaded connector to be turned during the active stroke of said piston; first mounting means for mounting said drive lever means intermediate its ends on said connecting means for tilting movement about a first pivot axis with the other end of said drive lever means operatively connected to said piston; elongated drive link means provided in the region of one end for drivingly engaging a polygonal member of a second threaded connector to be turned during the active stroke of said piston; elongated anchoring link means provided in the region of one end for engaging a polygonal member of a second threaded connector adjacent said first threaded connector; and second mounting means for releasably connecting the other end of either said drive link means or said anchoring link means to said connecting means for tilting movement about a second pivot axis parallel to and transversely spaced from said first pivot axis, whereby when the drive link means is connected to said connecting means two threaded connectors may be turned simultaneously during the active stroke of said piston, while when said anchoring link means is connected to said connecting means the full force of said cylinder-and-piston means may be used to drive only said first threaded connector while said anchoring link means transmits the reaction force created during such turning to said second threaded connector.

2. A hydraulic wrench as defined in claim 1, and including means attached to and projecting from said connecting means and carrying said second mounting means spaced from said connecting means for changing the distance between said first and second pivot axes.

3. A hydraulic wrench as defined in claim 2, wherein said distance changing means is constructed to maintain the distance between said first and second pivot axes substantially equal to the center distance between said first and said second threaded connector when either said drive link means or said anchoring link means is attached to said connecting means, or when said anchoring link means is attached to said connecting means to maintain the distance between said first and second pivot axes smaller than the center distance between said first and said second threaded connector so as to increase the force with which said first threaded connector is turned.

4. A hydraulic wrench as defined in claim 3, wherein said connecting means comprise elongated side plate means attached to the cylinder of said cylinder-and-piston means.

5. A hydraulic wrench as defined in claim 3, wherein said distance changing means comprises a pair of arm means and means to fasten one of said arm means at any selected angular position to said connecting means and to fasten the other arm means at one end at any selected angular position to said one arm means, said second mounting means being arranged on the other end of said other arm means.

6. A hydraulic wrench as defined in claim 2, wherein said elongated anchoring link means comprises elongated plate means connected at one end to said distance changing means for tilting movement about said second pivot axis and means in the region of the other end thereof for at least partly surrounding said second threaded connector while permitting said plate means to freely tilt relative thereto.

7. A hydraulic wrench as defined in claim 5, wherein said fastening means comprises a pair of spline connections for fastening one of said arm means to said connecting means and for fastening said one end of said other arm means to said one arm means.

8. In a hydraulic wrench comprising fluid-operated cylinder-and-piston means; connecting means attached to the cylinder of said cylinder-and-piston means; drive lever means provided in the region of one end thereof with means for drivingly engaging a polygonal member of a first threaded connector to be turned during operation of said cylinder-and-piston means; first mounting means for mounting said drive lever means intermediate its ends on said connecting means tiltable about a first pivot axis with the other end of said drive lever means operatively connected to said piston of said cylinder-and-piston means; elongated link means provided in the region of one end for engaging a polygonal member of a second threaded connector spaced from said first threaded connector; second mounting means for mounting the other end of said elongated link means tiltable about a second pivot axis spaced from and parallel to said first pivot axis; and distance changing means for changing the distance between said first and said second pivot axes, said distance changing means being attached at one end to said connecting means projecting from the latter and carrying said second mounting means in the region of the other end.

9. A hydraulic wrench as defined in claim 8, wherein said distance changing means comprises a pair of arm means and spline connections for attaching one end of one of said arm means at any selected angular position to said connecting means and to attach one end of said other arm means at any selected angular position to the other end of said one arm means, said second pivot axis being located at the region of the other end of said other arm means.

* * * * *